US008516982B2

(12) United States Patent
David et al.

(10) Patent No.: US 8,516,982 B2
(45) Date of Patent: Aug. 27, 2013

(54) HARMONIC DRIVE CAMSHAFT PHASER AND METHOD FOR USING

(75) Inventors: Pascal David, Beidweiler (LU); Pierre Kimus, Attert (BE); Michael James Fox, Stafford, NY (US)

(73) Assignee: Delphi Technologies, Inc., Troy, MI (US)

( * ) Notice: Subject to any disclaimer, the term of this patent is extended or adjusted under 35 U.S.C. 154(b) by 678 days.

(21) Appl. No.: 12/825,806

(22) Filed: Jun. 29, 2010

(65) Prior Publication Data

US 2011/0315102 A1 Dec. 29, 2011

(51) Int. Cl.
*F01L 1/34* (2006.01)

(52) U.S. Cl.
USPC ..... 123/90.17; 29/888.1

(58) Field of Classification Search
USPC ..... 123/90.15, 90.17; 74/567, 568 R; 29/888.1; 464/160, 161
See application file for complete search history.

(56) References Cited

U.S. PATENT DOCUMENTS

| | | | | |
|---|---|---|---|---|
| 5,417,186 | A | 5/1995 | Elrod et al. | |
| 6,302,073 | B1 * | 10/2001 | Heer | 123/90.17 |
| 6,328,006 | B1 | 12/2001 | Heer | |
| 7,421,990 | B2 * | 9/2008 | Taye et al. | 123/90.17 |

* cited by examiner

*Primary Examiner* — Thomas Denion
*Assistant Examiner* — Daniel Bernstein
(74) *Attorney, Agent, or Firm* — Thomas N. Twomey

(57) ABSTRACT

A camshaft phaser includes a housing with a harmonic gear drive unit disposed therein. The harmonic gear drive unit includes a circular spline and a dynamic spline, a flexspline disposed radially within the circular spline and the dynamic spline, a wave generator disposed radially within the flexspline, and a rotational actuator connectable to the wave generator. One of the circular spline and the dynamic spline is fixed to the housing. A hub is rotatably disposed radially within the housing and attachable to the camshaft and fixed to the other of the circular spline and the dynamic spline. An anti-rotation means is provided for temporarily fixing the circular spline to the dynamic spline in order to prevent relative rotation therebetween when the hub is being attached to the camshaft. The anti-rotation means prevents damage to the harmonic gear drive unit while the camshaft phaser is being installed onto the camshaft.

21 Claims, 4 Drawing Sheets

HARMONIC DRIVE CAMSHAFT PHASER AND METHOD FOR USING

TECHNICAL FIELD OF INVENTION

The present invention relates to an electric variable cam phaser (eVCP) which uses an electric motor and a harmonic drive unit to vary the phase relationship between a crankshaft and a camshaft in an internal combustion engine; more particularly, to an eVCP with means for preventing damage to the harmonic drive unit while the eVCP is being attached to the camshaft; and even more particularly to a method for attaching the eVCP to the camshaft.

BACKGROUND OF INVENTION

Camshaft phasers ("cam phasers") for varying the timing of combustion valves in internal combustion engines are well known. A first element, known generally as a sprocket element, is driven by a chain, belt, or gearing from an engine's crankshaft. A second element, known generally as a camshaft plate, is mounted to the end of an engine's camshaft.

U.S. patent application Ser. No. 12/536,575; U.S. Provisional Patent Application Ser. No. 61/253,982; and U.S. Provisional Patent Application Ser. No. 61/333,775; which are commonly owned by Applicant and incorporated herein by reference in their entirety; disclose an eVCP camshaft phaser comprising a flat harmonic drive unit having a circular spline and a dynamic spline linked by a common flexspline within the circular and dynamic splines, and a single wave generator disposed within the flexspline. The circular spline is connectable to either of an engine camshaft or an engine crankshaft driven rotationally and fixed to a housing, the dynamic spline being connectable to the other thereof. The wave generator is driven selectively by an electric motor to cause the dynamic spline to rotate past the circular spline, thereby changing the phase relationship between the crankshaft and the camshaft.

The eVCP is attached to the camshaft with a bolt that extends axially through the eVCP and threadably engages the camshaft. In this way, the eVCP is clamped between the head of the bolt and the camshaft. While the eVCP is being attached to the camshaft, the housing of the eVCP is prevented from rotating by the chain, belt, or gearing which is connected to the crankshaft. As the bolt is tightened, friction is generated between the head of the bolt and the eVCP. This friction applies a torque that can cause undesired relative movement between the circular spline and the dynamic spline.

What is needed is an eVCP with means for temporarily fixing the circular spline to the dynamic spline in order to prevent relative rotation therebetween while the eVCP is being attached to said camshaft.

SUMMARY OF THE INVENTION

Briefly described, a camshaft phaser is provided for controllably varying the phase relationship between a crankshaft and a camshaft in an internal combustion engine. The camshaft phaser includes a housing having a bore with a longitudinal axis and a harmonic gear drive unit is disposed therein. The harmonic gear drive unit includes a circular spline and a dynamic spline, a flexspline disposed radially within the circular spline and the dynamic spline, a wave generator disposed radially within the flexspline, and a rotational actuator connectable to the wave generator. One of the circular spline and the dynamic spline is fixed to the housing in order to prevent relative rotation therebetween. A hub is rotatably disposed within the housing and attachable to the camshaft and fixed to the other of the circular spline and the dynamic spline in order to prevent relative rotation therebetween. An anti-rotation means is provided for temporarily fixing the circular spline to the dynamic spline in order to prevent relative rotation therebetween when the hub is being attached to the camshaft.

BRIEF DESCRIPTION OF DRAWINGS

This invention will be further described with reference to the accompanying drawings in which.

DETAILED DESCRIPTION OF INVENTION

Figure 1:
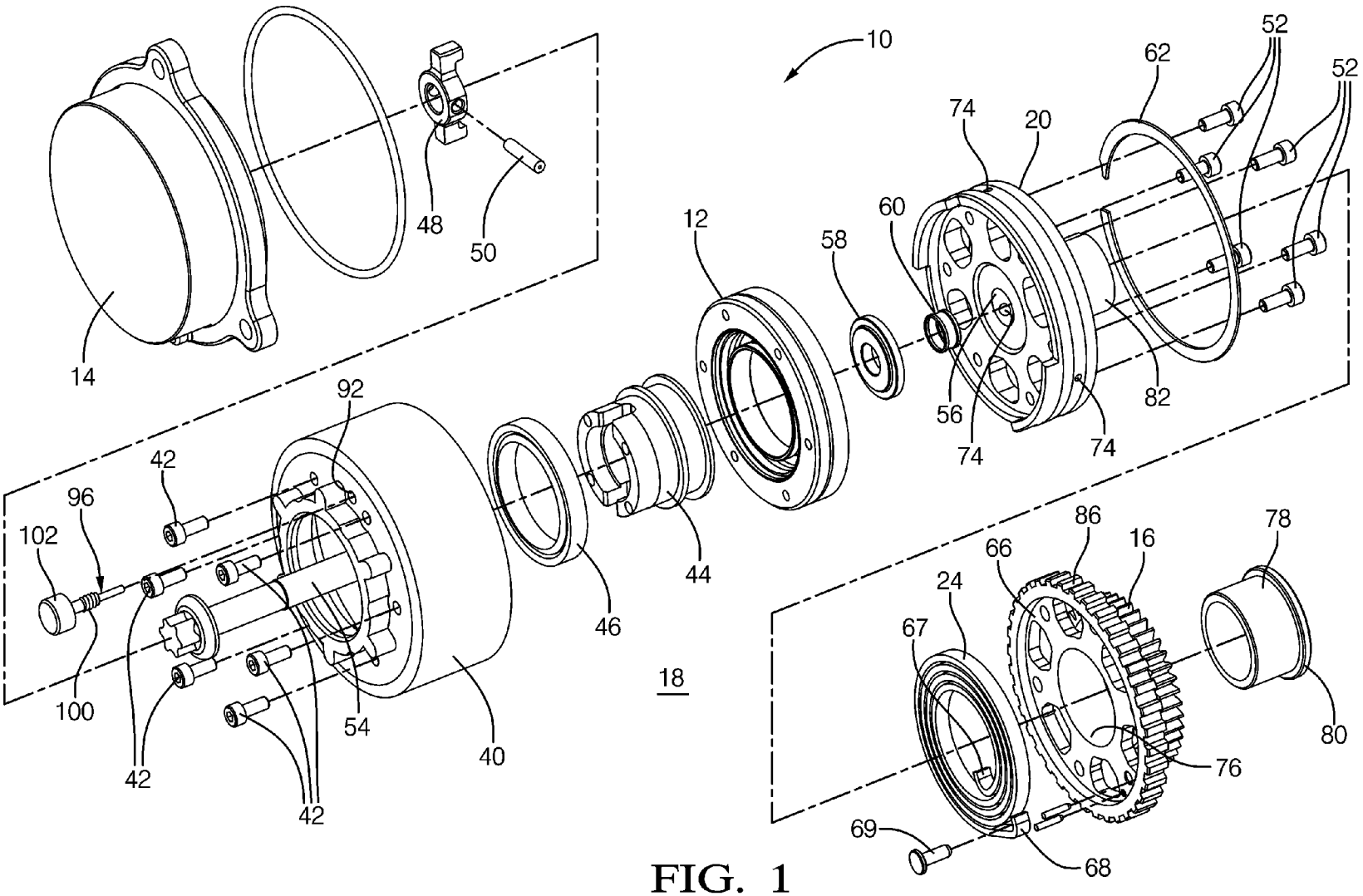
FIG. 1 is an exploded isometric view of an eVCP in accordance with the present invention.
Figure 2:
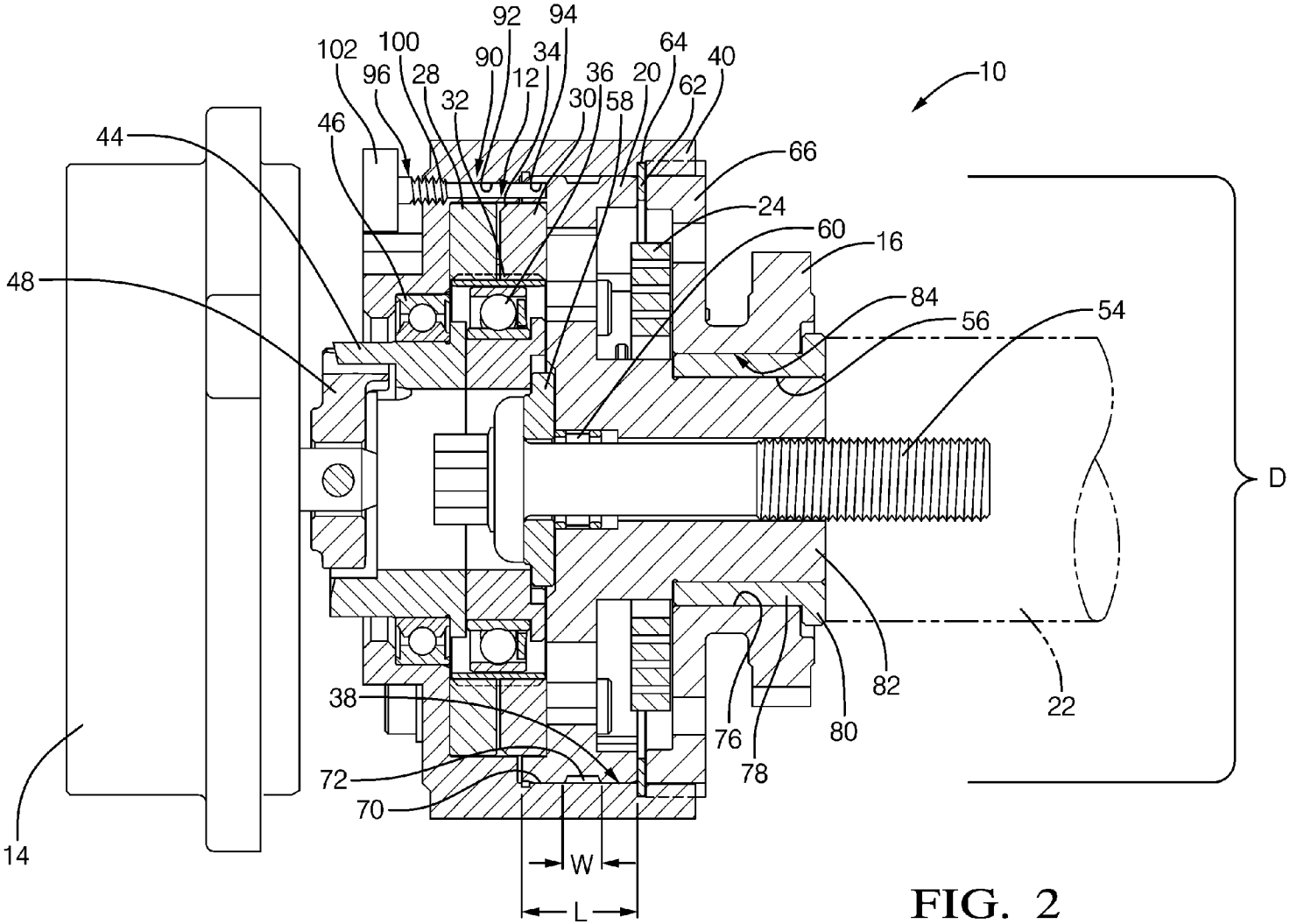
FIG. 2 is an axial cross-section of an eVCP in accordance with the present invention with an anti-rotation pin installed in order to prevent relative rotation between the circular spline to said dynamic spline while the eVCP is being attached to a camshaft.

Referring to FIGS. 1 and 2, an eVCP 10 in accordance with the present invention comprises a flat harmonic gear drive unit 12; a rotational actuator 14 that may be a hydraulic motor but is preferably a DC electric motor, operationally connected to harmonic gear drive unit 12; an input sprocket 16 operationally connected to harmonic gear drive unit 12 and drivable by a crankshaft (not shown) of engine 18; an output hub 20 attached to harmonic gear drive unit 12 and mountable to an end of an engine camshaft 22; and a bias spring 24 operationally disposed between output hub 20 and input sprocket 16. Electric motor 14 may be an axial-flux DC motor.

Harmonic gear drive unit 12 comprises an outer first spline 28 which may be either a circular spline or a dynamic spline as described below; an outer second spline 30 which is the opposite (dynamic or circular) of first spline 28 and is coaxially positioned adjacent first spline 28; a flexspline 32 disposed radially inwards of both first and second splines 28, 30 and having outwardly-extending gear teeth disposed for engaging inwardly-extending gear teeth on both first and second splines 28, 30; and a wave generator 36 disposed radially inwards of and engaging flexspline 32.

Flexspline 32 is a non-rigid ring with external teeth on a slightly smaller pitch diameter than the circular spline. It is fitted over and elastically deflected by wave generator 36.

The circular spline is a rigid ring with internal teeth engaging the teeth of flexspline 32 across the major axis of wave generator 36. The circular spline serves as the input member.

The dynamic spline is a rigid ring having internal teeth of the same number as flexspline 32. It rotates together with flexspline 32 and serves as the output member. Either the dynamic spline or the circular spline may be identified by a chamfered corner 34 at its outside diameter to distinguish one spline from the other.

As is disclosed in the prior art, wave generator 36 is an assembly of an elliptical steel disc supporting an elliptical bearing, the combination defining a wave generator plug. A flexible bearing retainer surrounds the elliptical bearing and engages flexspline 32. Rotation of the wave generator plug causes a rotational wave to be generated in flexspline 32

(actually two waves 180° apart, corresponding to opposite ends of the major ellipse axis of the disc).

During assembly of harmonic gear drive unit 12, flexspline teeth engage both circular spline teeth and dynamic spline teeth along and near the major elliptical axis of the wave generator. The dynamic spline has the same number of teeth as the flexspline, so rotation of the wave generator causes no net rotation per revolution therebetween. However, the circular spline has slightly fewer gear teeth than does the dynamic spline, and therefore the circular spline rotates past the dynamic spline during rotation of the wave generator plug, defining a gear ratio therebetween (for example, a gear ratio of 50:1 would mean that 1 rotation of the circular spline past the dynamic spline corresponds to 50 rotations of the wave generator). Harmonic gear drive unit 12 is thus a high-ratio gear transmission; that is, the angular phase relationship between first spline 28 and second spline 30 changes by 2% for every revolution of wave generator 36.

Of course, as will be obvious to those skilled in the art, the circular spline rather may have slightly more teeth than the dynamic spline has, in which case the rotational relationships described below are reversed.

Still referring to FIGS. 1 and 2, input sprocket 16 is fixed to a generally cup-shaped sprocket housing 40 that is fastened by bolts 42 to first spline 28 in order to prevent relative rotation therebetween. Coupling adaptor 44 is mounted to wave generator 36 and extends through sprocket housing 40, being supported by bearing 46 mounted in sprocket housing 40. Coupling adapter 44 may be made of two separate pieces that are joined together as shown in FIG. 2. Coupling 48 mounted to the motor shaft of electric motor 14 and pinned thereto by pin 50 engages coupling adaptor 44, permitting wave generator 36 to be rotationally driven by electric motor 14, as may be desired to alter the phase relationship between first spline 28 and second spline 30.

Output hub 20 is fastened to second spline 30 by bolts 52 and may be secured to engine camshaft 22 by central through-bolt 54 extending through output hub axial bore 56 in output hub 20, and capturing stepped thrust washer 58 and filter 60 recessed in output hub 20. In an eVCP, it is necessary to limit radial run-out between the input hub and output hub. In the prior art, this has been done by providing multiple roller bearings to maintain concentricity between the input and output hubs. Referring to FIG. 2, radial run-out is limited by a single journal bearing interface 38 between sprocket housing 40 (input hub) and output hub 20, thereby reducing the overall axial length of eVCP 10 and its cost to manufacture. Output hub 20 is retained within sprocket housing 40 by snap ring 62 disposed in an annular groove 64 formed in sprocket housing 40.

Back plate 66, which is integrally formed with input sprocket 16, captures bias spring 24 against output hub 20. Inner spring tang 67 is engaged by output hub 20, and outer spring tang 68 is attached to back plate 66 by pin 69. In the event of an electric motor malfunction, bias spring 24 is biased to back-drive harmonic gear drive unit 12 without help from electric motor 14 to a rotational position of second spline 30 wherein engine 18 will start or run, which position may be at one of the extreme ends of the range of authority or intermediate of the phaser's extreme ends of its rotational range of authority. For example, the rotational range of travel in which bias spring 24 biases harmonic gear drive unit 12 may be limited to something short of the end stop position of the phaser's range of authority. Such an arrangement would be useful for engines requiring an intermediate park position for idle or restart.

The nominal diameter of output hub 20 is D; the nominal axial length of first journal bearing 70 is L; and the nominal axial length of the oil groove 72 formed in either output hub 20 (shown) and/or in sprocket housing 40 (not shown) for supplying oil to first journal bearing 70 is W. In addition to journal bearing clearance, the length L of the journal bearing in relation to output hub diameter D controls how much output hub 20 can tip within sprocket housing 40. The width of oil groove 72 in relation to journal bearing length L controls how much bearing contact area is available to carry the radial load. Experimentation has shown that a currently preferred range of the ratio L/D may be between about 0.25 and about 0.40, and that a currently preferred range of the ratio W/L may be between about 0.15 and about 0.70.

Oil provided by engine 18 is supplied to oil groove 72 by one or more oil passages 74 that extend radially from output hub axial bore 56 of output hub 20 to oil groove 72. Filter 60 filters contaminants from the incoming oil before entering oil passages 74. Filter 60 also filters contaminants from the incoming oil before being supplied to harmonic gear drive unit 12 and bearing 46. Filter 60 is a band-type filter that may be a screen or mesh and may be made from any number of different materials that are known in the art of oil filtering.

Extension portion 82 of output hub 20 receives bushing 78 in a press fit manner. In this way, output hub 20 is fixed to bushing 78. Input sprocket axial bore 76 interfaces in a sliding fit manner with bushing 78 to form second journal bearing 84. This provides support for the radial drive load placed on input sprocket 16 and prevents the radial drive load from tipping first journal bearing 70 which could cause binding and wear issues for first journal bearing 70. Bushing 78 includes radial flange 80 which serves to axially retain back plate 66/input sprocket 16. Alternatively, but not shown, bushing 78 may be eliminated and input sprocket axial bore 76 could interface in a sliding fit manner with extension portion 82 of output hub 20 to form second journal bearing 84 and thereby provide the support for the radial drive load placed on input sprocket 16. In this alternative, back plate 66/input sprocket 16 may be axially retained by a snap ring (not shown) received in a groove (not shown) of extension portion 82.

Figure 3:
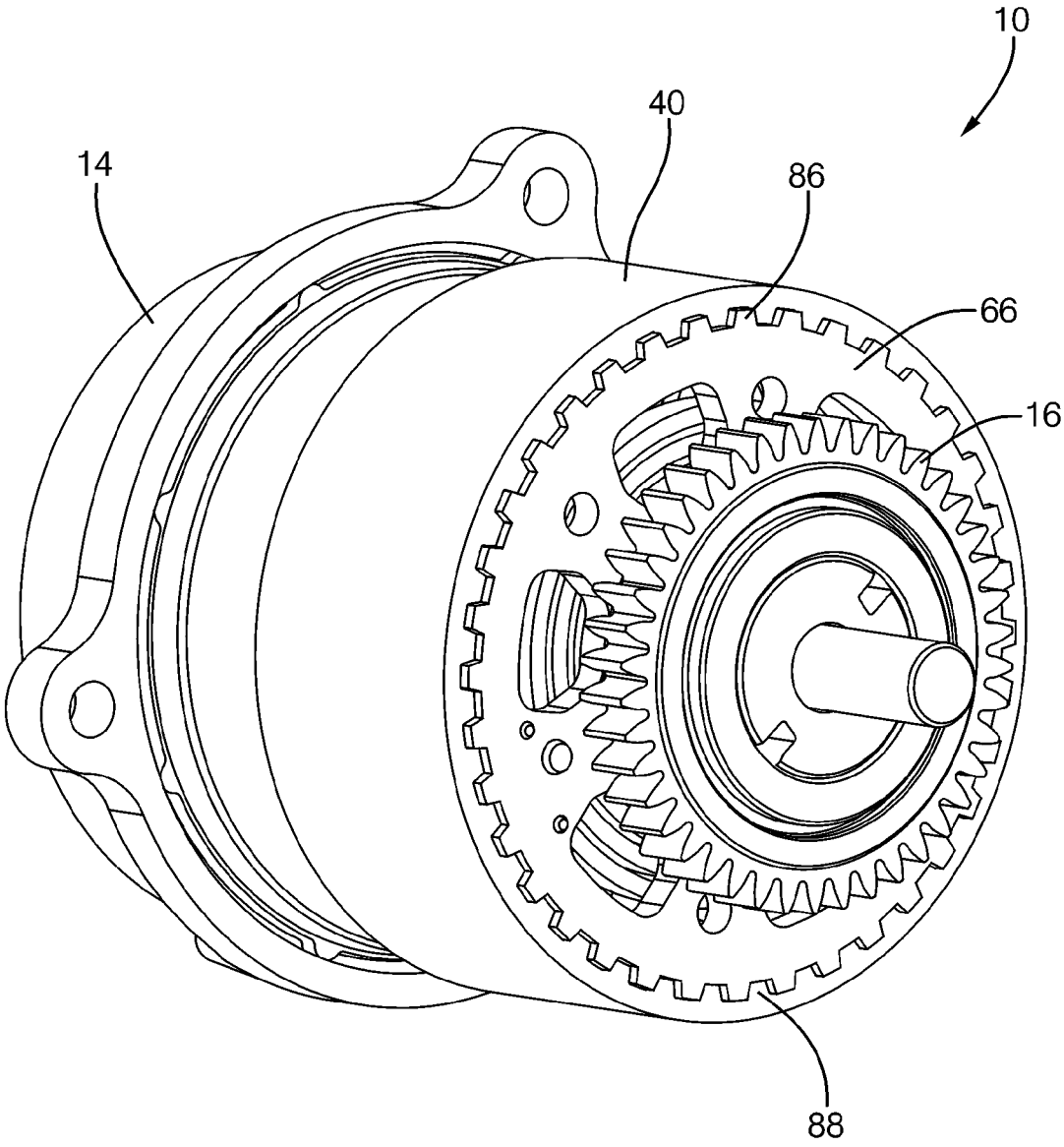
FIG. 3 is an isometric view of an eVCP in accordance with the present invention.

In order to transmit torque from input sprocket 16/back plate 66 to sprocket housing 40 and referring to FIGS. 1-3, a sleeve gear type joint is used in which back plate 66 includes external splines 86 which slidingly fit with internal splines 88 included within sprocket housing 40. The sliding fit nature of the splines 86, 88 eliminates or significantly reduces the radial tolerance stack issue between first journal bearing 70 and second journal bearing 84 because the two journal bearings 70, 84 operate independently and do not transfer load from one to the other. If this tolerance stack issue were not resolved, manufacture of the two journal bearings would be prohibitive in mass production because of component size and concentricity tolerances that would need to be maintained. The sleeve gear arrangement also eliminates then need for a bolted flange arrangement to rotationally fix back plate 66 to sprocket housing 40 which minimizes size and mass. Additionally, splines 86, 88 lend themselves to fabrication methods where they can be net formed onto back plate 66 and into sprocket housing 40 respectively. Splines 86, 88 may be made, for example, by powder metal process or by standard gear cutting methods.

While bolt 54 is being tightened with a predetermined torque in order to attach eVCP 10 to camshaft 22, the bolt head of bolt 54/thrust washer 58 can create friction with output hub 20 sufficient in magnitude to create torque that generates relative rotational movement between first and second splines 28, 30. This relative rotation can damage harmonic gear drive unit 12 because sprocket housing 40 is prevented from rotating due to the chain (not shown) attached to drive sprocket 16 and the engine crankshaft (not shown). In order to prevent relative rotation between first and second splines 28, 30, anti-rotation means 90 is provided. Anti-rotation means 90 includes first hole 92 extending axially through sprocket housing 40, second hole 94 extending axially into output hub 20 and alignable with first hole 92, and removable anti-rotation pin 96 insertable in first and second holes 92, 94. Since sprocket housing 40 is fixed to first spline 28 and output hub 20 is fixed to second spline 30, anti-rotation pin 96 prevents relative rotation between first and second splines 28, 30 when anti-rotation pin 96 is located in first and second holes 92, 94. In this way, bolt 54 can be tightened without damaging harmonic drive gear unit 12. After bolt 54 has been tightened with the predetermined torque, anti-rotation pin 96 is removed and may be replaced with plug 98 (FIG. 4) which extends only into first hole 92. Plug 98 may prevent contamination from entering eVCP 10 and may also prevent oil from exiting eVCP 10. While not shown, it may be necessary for electric motor 14 to not be assembled to eVCP 10 in order to provide sufficient clearance for installation and removal of anti-rotation pin 96 and plug 98.

Anti-rotation pin 96 may be made of any material with sufficient strength to withstand the forces generated when bolt 54 is tightened. This may include a polymer material, but is preferably a metal, and is more preferably steel.

Anti-rotation pin 96 may include pin threaded section 100 which threadably engages first hole 92. Alternatively, threaded section 100 may threadably engage second hole 94. In this way, anti-rotation pin 96 is prevented from inadvertently migrating out of first and second holes 92, 94 during manufacturing processes or transportation. Although not shown, the anti-rotation pin may alternatively form an interference fit with at least one of the first and second holes rather than being threadably engaged with one of the first and second holes. The interference fit may provide adequate retention of the anti-rotation pin while saving the time and expense of threading the anti-rotation pin and one of the holes. Also alternatively, the anti-rotation pin may fit with the first and second holes in a close sliding relationship rather than being threadably engaged with one of the first and second holes. The close sliding relationship may be desirable when the anti-rotation pin is installed in the first and second holes just before bolt 54 is tightened and therefore retention of the anti-rotation pin within the first and second holes is not necessary. The close sliding relationship allows for easy insertion and removal of the anti-rotation pin to and from the first and second holes.

Anti-rotation pin 96 may also include radially enlarged section 102 at the end of anti-rotation pin 96 that is not disposed in first and second holes 92, 94. Enlarged section 102 may allow for easier installation and removal of anti-rotation pin 96 by hand via an assembly worker.

Although not shown, enlarged section 102 may be shaped to receive a tool in order to aid installation and removal of anti-rotation pin 96. The enlarged section 102 may be shaped to receive a hex drive, Torx® drive, screw driver, square drive, or any other shape drive tool that is known for driving a threaded member.

Figure 4:
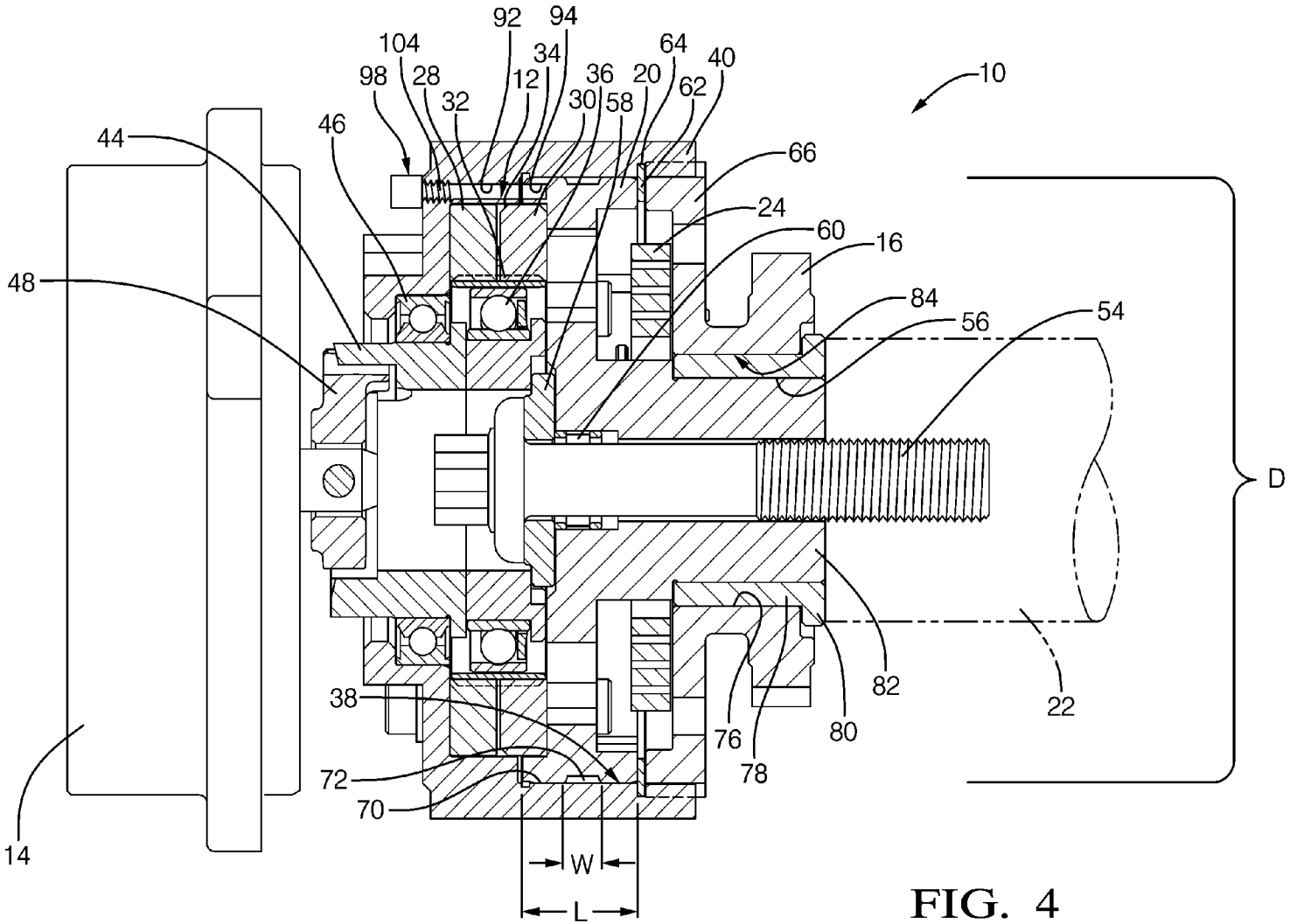
FIG. 4 is an axial cross-section of an eVCP in accordance with the present invention with a plug installed in place of the anti-rotation pin after the eVCP has been attached to the camshaft.

Referring to FIG. 4, plug 98 may include plug threaded section 104 which threadably engages first hole 92. In this way, plug 92 is prevented from inadvertently migrating out of first hole 92 during operation of eVCP 10. Although not shown, the plug may alternatively form an interference fit with the hole rather than being threadably engaged with the first hole. The interference fit may provide adequate retention of the plug while saving the time and expense of threading the plug and the first hole.

Although not shown, plug 98 may be shaped to receive a tool to aid installation of plug 98. Plug 98 may be shaped to receive a hex drive, Torx® drive, screw driver, square drive, or any other shape drive tool that is known for driving a threaded member.

While not shown, it should now be understood that eVCP 10 may include a plurality of anti-rotation means. A plurality of anti-rotation means may be necessary, for example, when a single anti-rotation pin is unable to be sufficiently sized to withstand the forces generated when bolt 54 is tightened. The plurality of anti-rotation means allows for the forces to be distributed to a plurality of anti-rotation pins and therefore each pin would be required to withstand a smaller force.

While the embodiment described herein shows first hole 92 disposed in sprocket housing 40 and second hole 94 disposed in output hub 20, it should now be understood that first hole 92 may be disposed in any member fixed to one of first and second splines 28, 30. Likewise second hole 94 may be disposed in any member fixed to the other of first and second splines 28, 30. It is also possible to dispose one or both of first and second holes 92, 94 directly in one or both of first and second splines 28, 30 rather than to members fixed thereto.

While the embodiment described herein describes first hole 92 extending axially through sprocket housing 40 and second hole 94 extending axially into output hub, it should now be understood that the first and second holes may alternatively extend substantially radially through the sprocket housing (or any member fixed to the first spline) and substantially radially into the output hub (or any member fixed to the second spline).

While the embodiment described herein describes input sprocket 16 as being smaller in diameter than sprocket housing 40 and disposed axially behind sprocket housing 40, it should now be understood that the input sprocket may be radially surrounding the sprocket housing and axially aligned therewith. In this example, the back plate may be press fit into the sprocket housing rather than having a sleeve gear type joint.

The embodiment described herein describes harmonic gear drive unit 12 as comprising outer first spline 28 which may be either a circular spline or a dynamic spline which serves as the input member; an outer second spline 30 which is the opposite (dynamic or circular) of first spline 28 and which serves as the output member and is coaxially positioned adjacent first spline 28; a flexspline 32 disposed radially inwards of both first and second splines 28, 30 and having outwardly-extending gear teeth disposed for engaging inwardly-extending gear teeth on both first and second splines 28, 30; and a wave generator 36 disposed radially inwards of and engaging flexspline 32. As described, harmonic gear drive unit 12 is a flat plate or pancake type harmonic gear drive unit as referred to in the art. However, it should now be understood that other types of harmonic gear drive units may be used in accordance with the present invention. For example, a cup type harmonic gear drive unit may be used. The cup type harmonic gear drive unit comprises a circular spline which serves as the input member; a flexspline which serves as the output member and which is disposed radially inwards of the circular spline and having outwardly-extending gear teeth disposed for engaging inwardly-extending gear teeth on the circular spline; and a wave generator disposed radially inwards of and engaging the flexspline.

While this invention has been described in terms of preferred embodiments thereof, it is not intended to be so limited, but rather only to the extent set forth in the claims that follow.

We claim:

1. A camshaft phaser for controllably varying the phase relationship between a crankshaft and a camshaft in an internal combustion engine, said camshaft phaser comprising:

a housing having a bore with a longitudinal axis;

a harmonic gear drive unit disposed radially within said housing, said harmonic gear drive unit comprising a circular spline and an axially adjacent dynamic spline, a flexspline disposed radially within said circular spline and said dynamic spline, a wave generator disposed radially within said flexspline, and a rotational actuator connectable to said wave generator, wherein one of said circular spline and said dynamic spline is fixed to said housing in order to prevent relative rotation therebetween;

a hub rotatably disposed radially within said housing axially adjacent to said harmonic gear drive unit and attachable to said camshaft and fixed to the other of said circular spline and said dynamic spline in order to prevent relative rotation therebetween; and an anti-rotation means for temporarily fixing said circular spline to said dynamic spline in order to prevent relative rotation therebetween when said hub is being attached to said camshaft.

2. The camshaft phaser as in claim 1 wherein said anti-rotation means comprises:

a first hole in a first member, said first member being fixed to one of said circular spline and said dynamic spline;

a second hole in a second member, said second hole being alignable with said first hole, and said second member being fixed to the other of said circular spline and said dynamic spline; and a removable anti-rotation pin insertable in said first and said second holes to temporarily fix said circular spline to said dynamic spline in order to prevent relative rotation therebetween.

3. The camshaft phaser as in claim 2 wherein said first member is said housing.

4. The camshaft phaser as in claim 3 wherein said second member is said hub.

5. A camshaft phaser as in claim 3 wherein said anti-rotation pin is threadably engaged with said first hole.

6. The camshaft phaser as in claim 2 wherein said anti-rotation pin is substantially parallel with said longitudinal axis.

7. The camshaft phaser as in claim 2 wherein said anti-rotation pin extends substantially radially outward from said longitudinal axis.

8. The camshaft phaser as in claim 2 wherein said anti-rotation pin is threadably engaged with one of said first and said second holes.

9. The camshaft phaser as in claim 2 wherein said anti-rotation pin includes a radially enlarged section to facilitate removal of said anti-rotation pin from said first and second holes.

10. The method for attaching a camshaft phaser to a camshaft of an internal combustion engine, said camshaft phaser for controllably varying the phase relationship between a crankshaft of said internal combustion engine and said camshaft, said camshaft phaser including a housing having a bore with a longitudinal axis; a harmonic gear drive unit disposed radially within said housing and comprising a circular spline and an axially adjacent dynamic spline, a flexspline disposed radially within said circular spline and said dynamic spline, a wave generator disposed radially within said flexspline, and a rotational actuator connectable to said wave generator, wherein one of said circular spline and said dynamic spline is fixed to said housing in order to prevent relative rotation therebetween; a hub rotatably disposed radially within said housing axially adjacent to said harmonic gear drive unit and attachable to said camshaft and fixed to the other of said circular spline and said dynamic spline in order to prevent relative rotation therebetween, said method for attaching said camshaft phaser to said camshaft comprising:

first, temporarily fixing said circular spline to said dynamic spline in order to prevent relative rotation therebetween;

second, securing said camshaft phaser to said camshaft; and third, decoupling said circular spline from said dynamic spline in order to permit relative rotation therebetween.

11. The method of claim 10 wherein the step of securing includes tightening a bolt with a predetermined torque, said bolt being threadably engaged with said camshaft.

12. The method of claim 10 wherein the step of temporarily fixing said circular spline to said dynamic spline includes inserting a removable anti-rotation pin into a first hole disposed in a first member fixed to one of said circular spline and said dynamic spline and inserting said removable anti-rotation pin into a second hole disposed in a second member fixed to the other of said circular spline and said dynamic spline.

13. The method of claim 12 wherein said first member is said housing and said second member is said hub.

14. The method of claim 12 wherein inserting said removable anti-rotation pin includes threadably engaging said removable anti-rotation pin with one of said first and said second holes.

15. The method of claim 14 wherein inserting said removable anti-rotation pin includes threadably engaging said removable anti-rotation pin with said first hole.

16. The method of claim 12 wherein the step of rotationally decoupling includes removing said anti-rotation pin from said first and second holes.

17. The method of claim 16 comprising inserting a plug into only one of said first and second holes after said anti-rotation pin has been removed from said first and said second holes.

18. A camshaft phaser for controllably varying the phase relationship between a crankshaft and a camshaft in an internal combustion engine, said camshaft phaser comprising:

a housing having a bore with a longitudinal axis;

a harmonic gear drive unit disposed radially within said housing, said harmonic gear drive unit including an input member, an output member, a wave generator disposed radially within said input member and said output member, and a rotational actuator connectable to said wave generator such that rotation of said wave generator causes relative rotation between said input member and said output member, wherein one of said input member and said output member is fixed to said housing in order to prevent relative rotation therebetween;

a hub rotatably disposed radially within said housing axially adjacent to said harmonic gear drive unit and attachable to said camshaft and fixed to the other of said input member and said output member in order to prevent relative rotation therebetween; and an anti-rotation means for temporarily fixing said input member to said output member in order to prevent relative rotation therebetween as said hub is being attached to said camshaft.

19. The camshaft phaser as in claim 18 wherein said input member is one of a circular spline and a dynamic spline and said output member is the other of said circular spline, wherein a flexspline is disposed within said circular spline and said dynamic spline and said wave generator is disposed within said flexspline.

20. The camshaft phaser as in claim 19 wherein said anti-rotation means comprises:

a first hole in a first member, said first member being fixed to one of said circular spline and said dynamic spline;

a second hole in a second member, said second hole being alignable with said first hole, and said second member being fixed to the other of said circular spline and said dynamic spline; and a removable anti-rotation pin insertable in said first and said second holes to temporarily fix said circular spline to said dynamic spline in order to prevent relative rotation therebetween.

21. A method for attaching a camshaft phaser to a camshaft of an internal combustion engine, said camshaft phaser for controllably varying the phase relationship between a crankshaft and a camshaft in an internal combustion engine, said camshaft phaser comprising a housing having a bore with a longitudinal axis; a harmonic gear drive unit disposed radially within said housing, said harmonic gear drive unit including an input member, an output member, a wave generator disposed radially within said input member and said output member, and a rotational actuator connectable to said wave generator such that rotation of said wave generator causes relative rotation between said input member and said output member, wherein one of said input member and said output member is fixed to said housing in order to prevent relative rotation therebetween; a hub rotatably disposed radially within said housing axially adjacent to said harmonic gear drive unit and attachable to said camshaft and fixed to the other of said input member and said output member in order to prevent relative rotation therebetween; and an anti-rotation means for temporarily fixing said input member to said output member in order to prevent relative rotation therebetween when said hub is being attached to said camshaft, said method for attaching said camshaft phaser to said camshaft comprising:

first, temporarily fixing said input member to said output member in order to prevent relative rotation therebetween;

second, securing said camshaft phaser to said camshaft; and third, decoupling said input member from said output member in order to permit relative rotation therebetween.

* * * * *